US005174392A

United States Patent [19]

Reinhardt

[11] Patent Number: 5,174,392

[45] Date of Patent: Dec. 29, 1992

[54] MECHANICALLY ACTUATED FLUID CONTROL DEVICE FOR DOWNHOLE FLUID MOTOR

[76] Inventor: Paul A. Reinhardt, 10006 Prairie Mist, Houston, Tex. 77088

[21] Appl. No.: 795,700

[22] Filed: Nov. 21, 1991

[51] Int. Cl.[5] ..... E21B 4/02

[52] U.S. Cl. ..... 175/107; 175/317

[58] Field of Search ..... 175/75, 97, 107, 65

[56] References Cited

U.S. PATENT DOCUMENTS

| | | | |
|---|---|---|---|
| 3,840,080 | 10/1974 | Berryman | 175/107 |
| 3,989,114 | 11/1976 | Tschirky et al. | 175/107 |
| 4,207,037 | 6/1980 | Riordan . | |
| 4,275,795 | 6/1981 | Beimgraben | 175/107 |
| 4,280,524 | 7/1981 | Beimgraben | 175/107 |
| 4,298,077 | 11/1981 | Emery | 175/107 |
| 4,333,539 | 6/1982 | Lyons et al. . | |
| 4,339,007 | 7/1982 | Clark | 175/107 |
| 4,434,862 | 3/1984 | Lyons . | |
| 4,553,611 | 11/1985 | Lyons . | |
| 4,768,598 | 9/1988 | Reinhardt | 175/107 |
| 4,936,397 | 6/1990 | McDonald et al. | 175/107 X |

*Primary Examiner*—Ramon S. Britts
*Assistant Examiner*—Frank S. Tsay
*Attorney, Agent, or Firm*—Vaden, Eickenroht, Thompson, Boulware & Feather

[57] ABSTRACT

Apparatus is disclosed for controlling the power supplied to a drill bit by a downhole fluid powered motor to prevent the motor from rotating the bit at high speeds when there is little or no weight in the bit while maintaining full circulation through the fit. Apparatus also disclosed for restricting the flow of drilling fluid of the drill pipe when circulation is fully or partially lost.

13 Claims, 6 Drawing Sheets

1
3
2
5
14
54
6
4
29
16
7
9
8
15
13
13
18
17
19
51
52
50
20
12
21
45
22
10
48
38
12
11
49
12
46
47
40
53
30
35
32
42
34
34
36
22
39
25
33
43
24
31
41
37
26
44
27
23
28
100

FIG. 5a
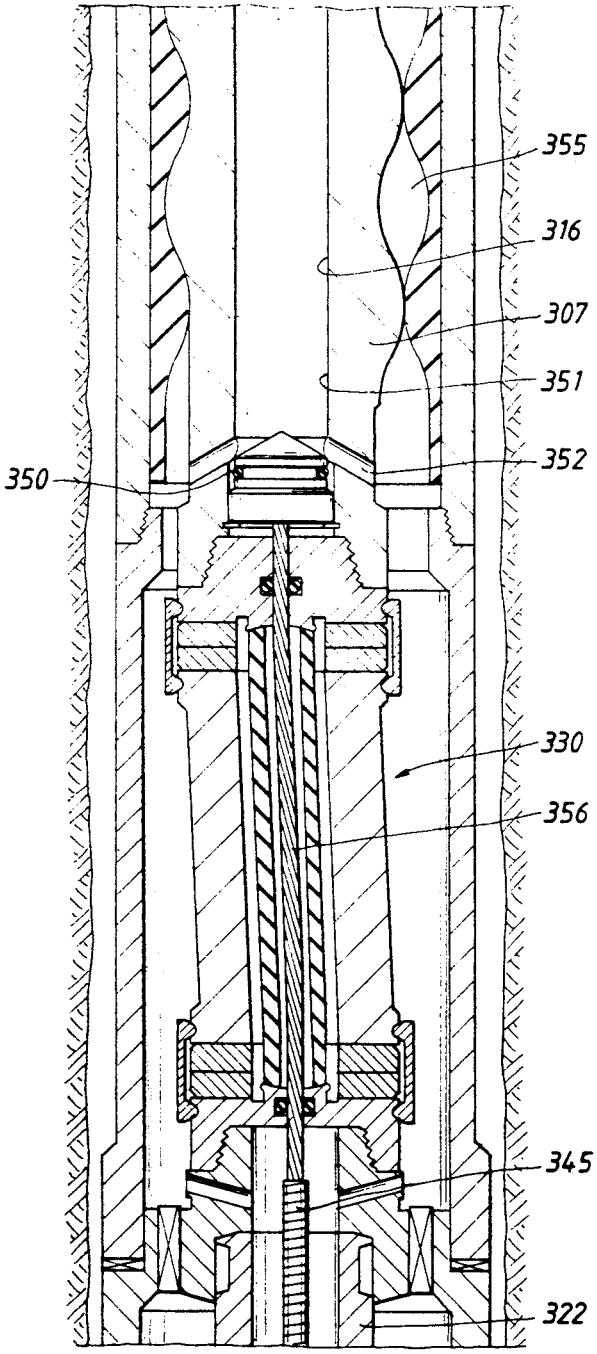
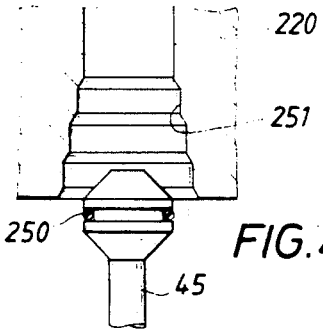
FIG. 4a
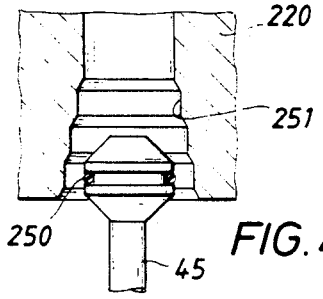
FIG. 4b
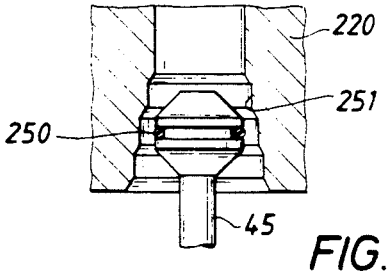
FIG. 4c
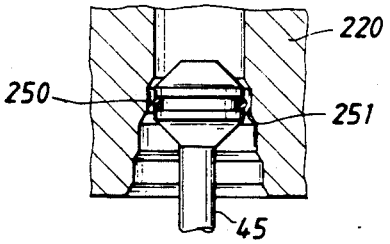
FIG. 4d
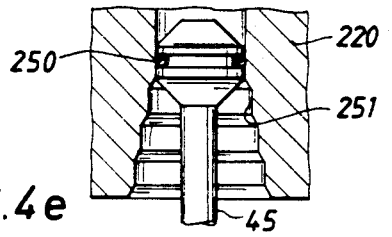
FIG. 4e

MECHANICALLY ACTUATED FLUID CONTROL DEVICE FOR DOWNHOLE FLUID MOTOR

The present invention relates to a combination of mechanically actuated bypass and speed/vibration control devices that are particularly suited for use in a fluid pressure actuated downhole drilling motor.

Downhole drilling motors have been used for years to drill boreholes in rock formations beneath the surface for oil production. There are different motors and different techniques used to perform the drilling.

Currently, air/foam drilling is a small portion of the oil and gas industry. However, new technology such as horizontal drilling, has sparked new interest to re-enter old oil fields searching for reserves left in place. These oil fields, many times, have lost their natural geopressure. Drilling new wells in these fields using incompressible fluids that create heavy fluid columns, as drilling media, can possibly plug the rock around the well bore making subsequent production of hydrocarbons very difficult. Thus, interest in air/foam drilling is increasing rapidly. Additionally, deep/hot drilling where vast natural gas reserves can be found, has been put on the back burner due to the depressed gas industry.

The current moineau motor technology uses stators made of elastomers in the power section. These stator elastomers start to lose their pressure/torque carrying capabilities at about 225 degrees fahrenheit and deteriorate rapidly so most companies will not use them where the downhole temperature is over 300 degrees F. Much deep gas is found in the 400–500 degree F geoclines. Thus, turbines have been looked to for fluid power drilling applications in these hot environments.

Turbines, due to problematic speed control, have limited life and also limit the life of the rock bits, which are run with them. The industry, for the above and other reasons, has, for now, abandoned serious turbine motor development and concentrated all their efforts into moineau devices. Obviously, there are problems associated with the use of both types of motors.

Moineau type or any positive displacement drilling motor overspeeds/vibrates when it is run on either compressible or incompressible fluids. The overspeed/vibration occurs in a motor run on a compressible fluid such as air or foam when the motor is picked up off bottom of a borehole during drilling to clean the hole of cuttings, or weight on bit is drilled off, or light weight and/or low torque rock bits are being used. Any of these occurrences reduces torsional resistance to the power imparting element (rotor) of the motor. Pressure resistance is then reduced and the compressible fluid expands causing excessive motor speed/vibration, which reduces the life of drilling motor. The overspeed/vibration occurs in a moineau motor run with an incompressible fluid at excessive flow rates that may be necessary to clean the hole of cuttings. Typically, to avoid the overspeed/vibration problem, some fluid is bypassed through the power element (rotor) through a fixed orifice. This, however, gives a less than desirable motor speed/horsepower degradation as torque is applied to this motor.

Turbine type drilling motors overspeed/vibrate when run on incompressible fluid similar in fashion to moineau type motors run on compressible fluid. Without bearing friction, the overspeeding/vibrating would be worse if the turbine were run on a compressible fluid such as air or foam.

Previous attempts to control the above-mentioned problems have produced very complicated motors, such as shown in the Reference text, W. Tiraspolsky, *Hydraulic Downhole Drilling Motors* 164–165, Gulf Publishing (1985), Library of Congress Cat. Card No. 85-70853, which are quite complicated in design, have limited capabilities in compressible fluids, and all exhaust drilling fluid above the stator. This is less than ideal because drill cuttings cannot be circulated from the bottom of the hole. This greatly increases the chance of sticking the drill string.

Slidable sleeve exhaust devices found in the same region above the power element not only heighten the chance of sticking (per reasons above) but are incompatible with the typical motor housing connections and become points of high stress concentration and potential bending/torsional failure. Such a failure could result in a motor coming apart downhole causing an expensive fishing operation, which isn't always successful.

Another increasingly popular way to prevent moineau type motors from overspeeding/vibrating when using compressible fluids is to provide flow restrictors in the rock bit. These restrictors cause the fluid to flow at a higher pressure thus a lower volume, and when pulled off bottom or weight is drilled off, the compressible fluid, still faced with restrictor resistance, will not expand relatively as much compared to a nonrestricted flow. This regime, however, proves more costly in surface equipment due to the need for compressor boosters and other necessary equipment. Additionally, this method wastes horsepower via the pressure loss across the bit restrictors.

Addressing the low pressure, high volume market, there is yet another method being marketed. This method utilizes an extremely high volume per revolution moineau motor (approximately three times conventional incompressible fluid designs). This tool captures a larger compressible fluid mass and thus, due to limited pressure available, can produce a greater torque with the same pressure than that of a conventional moineau tool. It also, due to the large volumes required, does not overspeed/vibrate relatively as severe as the conventional design, when run with similar volumes. There are drawbacks of this design. First, the motor is longer than conventional length which inhibits its radius building/steerable capabilities. Second, the motor is unable to convert to incompressible fluid with a flow rate which will be compatible with the hole size typically being drilled, that is to get any significant revolutions per minute out of an extreme volume tool, huge pumps would be required which typically aren't available when a well needs to be converted from compressible to incompressible fluid. This method, therefore, may prove to produce increases in rates of penetration; however, it will also be costly to the operator requiring extra equipment on location in case of fluids conversion.

As air/foam drilling goes to greater depths it becomes necessary to restrict the fluid column in order to deliver a sufficient volume and pressure of fluid to clean the greater length well bore. This compressed regime will take one back to the more conventional moineau motor designs utilizing restricted bits. Again this will call for even greater compressor/booster capability and still throw away horsepower loss across the bit.

Ideally, one would like to acquire all the restriction pressure necessary for volume delivery from torsional resistance of the moineau or turbine motor itself, and thus more efficiently use compressor power. This regime would add volume/pressure at the surface as additional weight, that is torque resistance is placed on the motor. The net volume of compressed fluid would basically stay the same. However, the pressure of that volume and net mass would increase. With any prior art motors, this operational regime is overspeed/vibration risky considering the possibility of the weight being drilled off or drill string having to be lifted off bottom to clean the hole.

Underbalanced drilling conditions with incompressible fluids present other problems during interruptions (for example, additions of drill pipe) where the fluid column in the drill string will run away into the formation. A solution to this problem is a device when configured in a normally closed regime can restrict or stop flow through the drilling motor when off bottom and allow flow, thus motor drilling, when on bottom. This type of device should allow one to utilize the fluid column as pressuring means for the fluid thus reducing pump pressure requirements. Devices commonly used to solve this problem, injection control valves, are located above the motor and require additional pressure to open them to flow, thus compound pressure requirements of the system and additionally burden the rock formation with pressure.

The cyclic nature of the drilling business combined with its wide variety of drilling parameters makes high utilization of equipment critical to success of drilling service companies.

Therefore, it is an object of this invention to provide a downhole drilling motor which can sustain all the restriction pressure necessary for volume delivery from torsional resistance without a high risk of overspeed/vibration.

It is a further object of this invention to provide a downhole drilling motor adaptable for both compressible and incompressible fluid regimes to reduce overall cost to the customer by minimizing equipment on location and to the vendor by increasing utilization of equipment because the one tool will address all applications.

It is a further object of this invention to provide a downhole motor which when the weight/torque is removed from the bit, a bypass is opened and the compressible fluid column can blow down through the bit, completely clean the hole, and not damage the tool with excessive volume expansion.

It is a further object of this invention to provide an apparatus dispensing with the need of a velocity close in bypass valves typically found in the top sub regions of conventional drilling motors which require a minimum flow rate to close, clog easily with trash and lost circulation material, must withstand the complete pressure differential of the motor and rock bit and, typically, add two-three feet to the drilling motor length.

It is a further object of this invention to provide a downhole drilling motor which opens and closes independent of flow rate, uses relatively high unit forces (generated by bit weight versus hydraulic pressure) to push trash away from the valve seat, only sees the pressure differential of the motor power section and will add to the motor only the length necessary to actuate and seal the device.

It is yet a further object of a normal closed embodiment of this invention to provide a downhole drilling motor used in an underbalanced condition with incompressible fluid to hold the column of fluid when off bottom during drilling interruptions and allow fluid to flow while on bottom, thus holding the fluid from running away while drilling is interrupted and using the fluid column as pressure means when drilling commences.

These and other objects, advantages and features of this invention will be apparent to those skilled in the art from a consideration of the specification, including the attached drawing and appended claims.

IN THE DRAWINGS

Figure 3A:
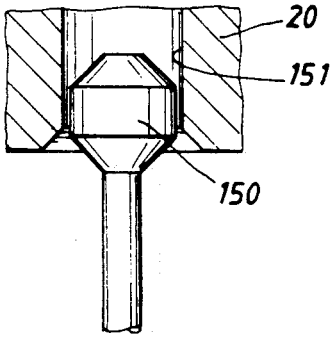
Figure 3B:
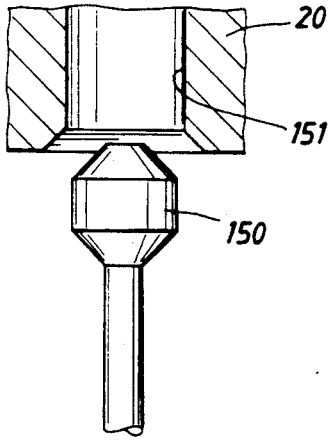

FIGS. 3*a* and 3*b* show a sectional view of an alternate embodiment of the bypass seat of the present invention in the closed and open position.

FIGS. 4*a*–4*e* show sectional views of an alternate embodiment of the bypass seal arrangement, a tuned bypass seal, of the present invention.

FIGS. 5*a*–5*e* are longitudinal sectional views of an alternate embodiment of the drilling motor of the present invention using a convention cardan type torque transmitting flex coupling member.

Figure 6:
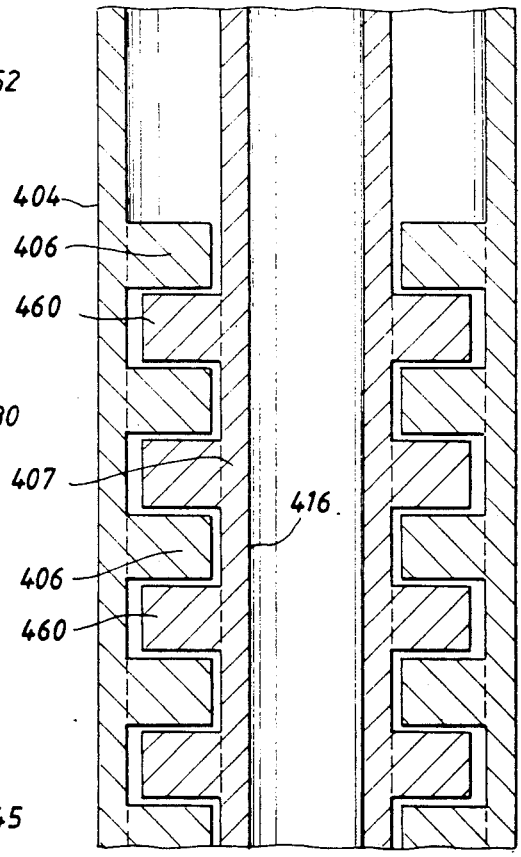

FIG. 6 is a sectional view of an alternate embodiment of the power section of the present invention.

Figure 7A:
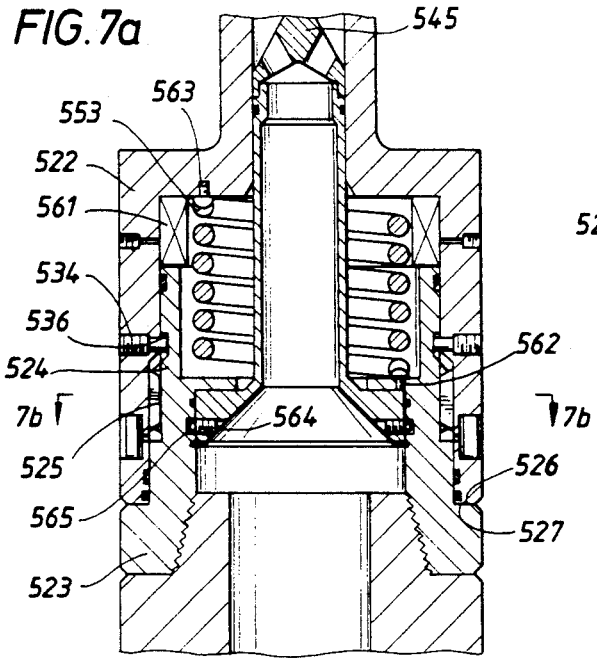
Figure 7B:
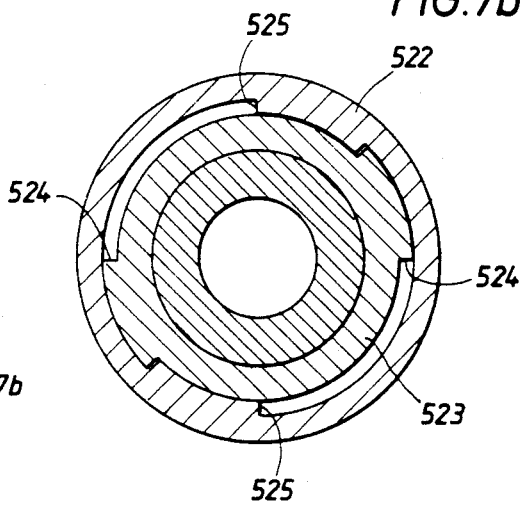
Figure 7C:
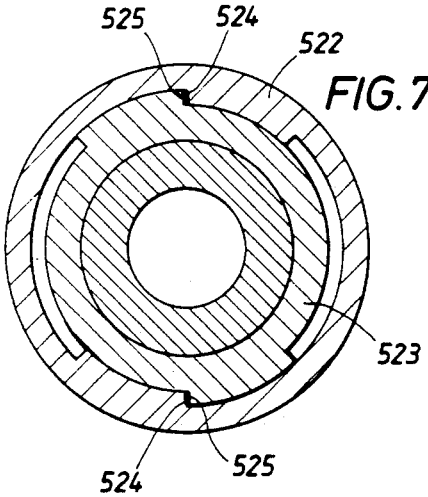

FIGS. 7*a*–7*c* are sectional views of an alternate embodiment of the actuating section of the present invention.

Figure 8A:
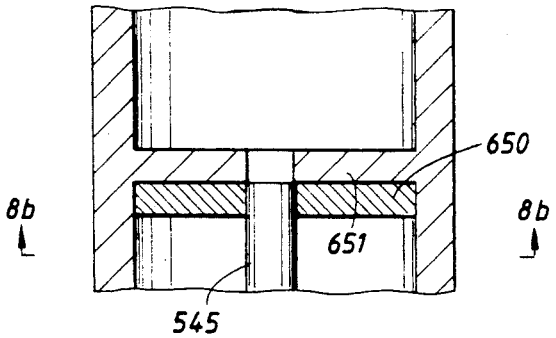
Figure 8B:
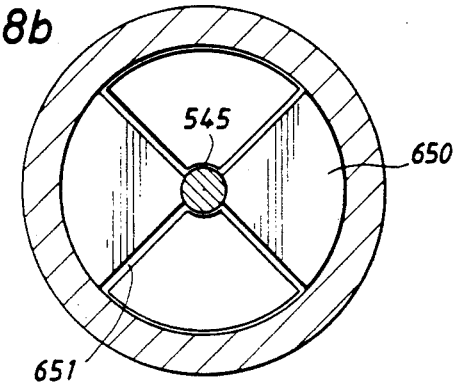
Figure 8C:
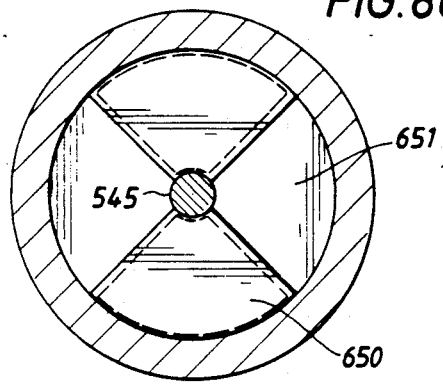

FIGS. 8*a*–8*c* are sectional views of a rotary gate type valve in accordance with an alternate embodiment of the present invention.

Figure 9A:
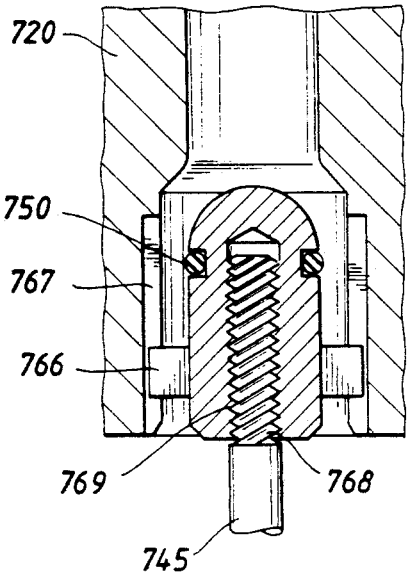
Figure 9B:
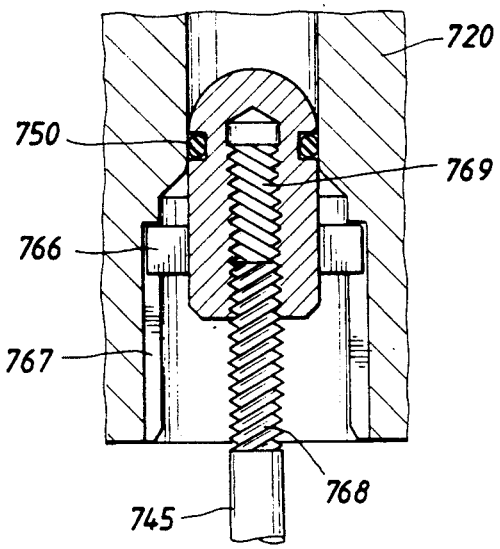

FIGS. 9*a*–9*b* are sectional views of an rotary actuated seal in both an open and closed position in accordance with an alternate embodiment of the present invention.

Figure 10A:
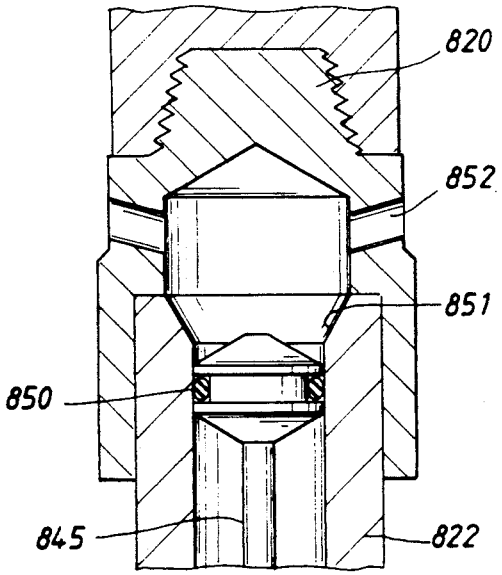
Figure 10B:
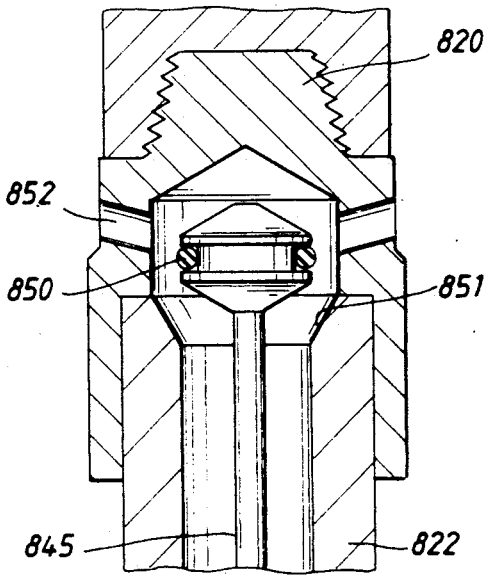

FIGS. 10*a*–10*b* are sectional views of a valving means that allows fluid to flow when in the closed position in accordance with an alternate embodiment of the present invention.

DESCRIPTION OF THE PREFERRED EMBODIMENT

Figure 1:
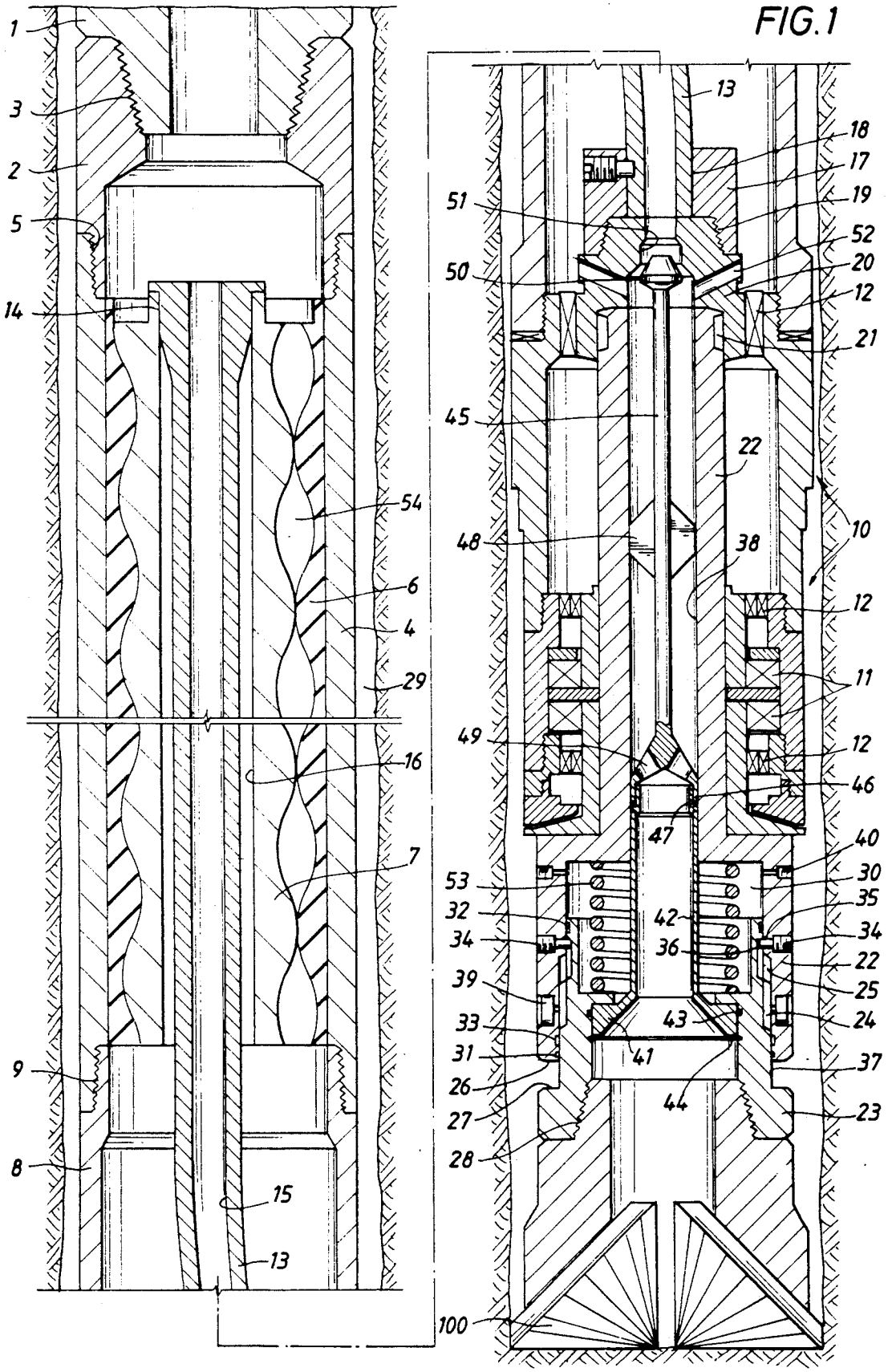
FIG. 1 is a longitudinal sectional view of the preferred embodiment of this invention with the actuator sub in the open position.

Referring to FIG. 1, a sectional view of preferred embodiment of this invention adapted to a moineau type drilling motor of this invention is shown. A drilling tubular or drill string 1 is attached to the motor top sub 2 via sealing, torque and weight carrying API (American Petroleum Institute) type thread 3 which readily adapts to standard drilling tubular. The top sub 2 is attached to a stator 4 via what is usually a custom vendor supplied sealing torque and weight carrying thread 5. Inside the stator 4 is the moineau rubber 6 which has one more lobe than its mating rotor 7.

The stator 4 is connected to a universal housing 8 via what is typically another custom thread 9 similar in function to thread 5. Universal housing 8 may have a bend, series of bends or adjustable bend in it which will facilitate what is commonly known as a steerable drilling. The universal housing 8 is connected to the bearing section, generally referred to as 10, via another typically custom thread (not numbered) similar to threads 9 and 5. The bearing section houses thrust 11 and radial bearings 12 to transmit loads from the drilling tubular 1 into the rock bit 100 for crushing and/or shearing through the rock. The path the loads follow will be outlined later in this discussion.

To the power portion of the motor, the rotor 7 is connected on top to a flexible, torque transmitting member 13 via a shrinkfit, spline, thread, or adequate torsion/thrust load carrying connection 14. A fluid conduit 15 is provided through the flexible member. The flexible member 13 is allowed to operate inside the rotor bore 16 which allows for the eccentric running of the rotor 7 inside the stator 4 and any additional clearance needed due to the possibility of bends in the universal housing 8. The flexible member 13 is connected to a torquing sub 17 via a connection 18 similar in function to connector 14. Connection 19 with torque transmittal/weight carrying/sealing functions connects the torquing sub 17 to the flow commingling/bypass seal sub 20 which is subsequently connected to the drive shaft 22 via a connection 21 which is similar in scope to connector 19.

Torque and rotation from the drive shaft 22 is transmitted to the actuating sub 23 via male and female spline type or equivalent drives 24 and 25.

Weight from the drilling tubular 1 is transmitted to the actuating sub via the top sub 2, stator 4, universal housing 8, bearing section 10 through the bearing section bearings 11 and 12 into the driveshaft 22 and through load faces 26 and 27.

Figure 2:
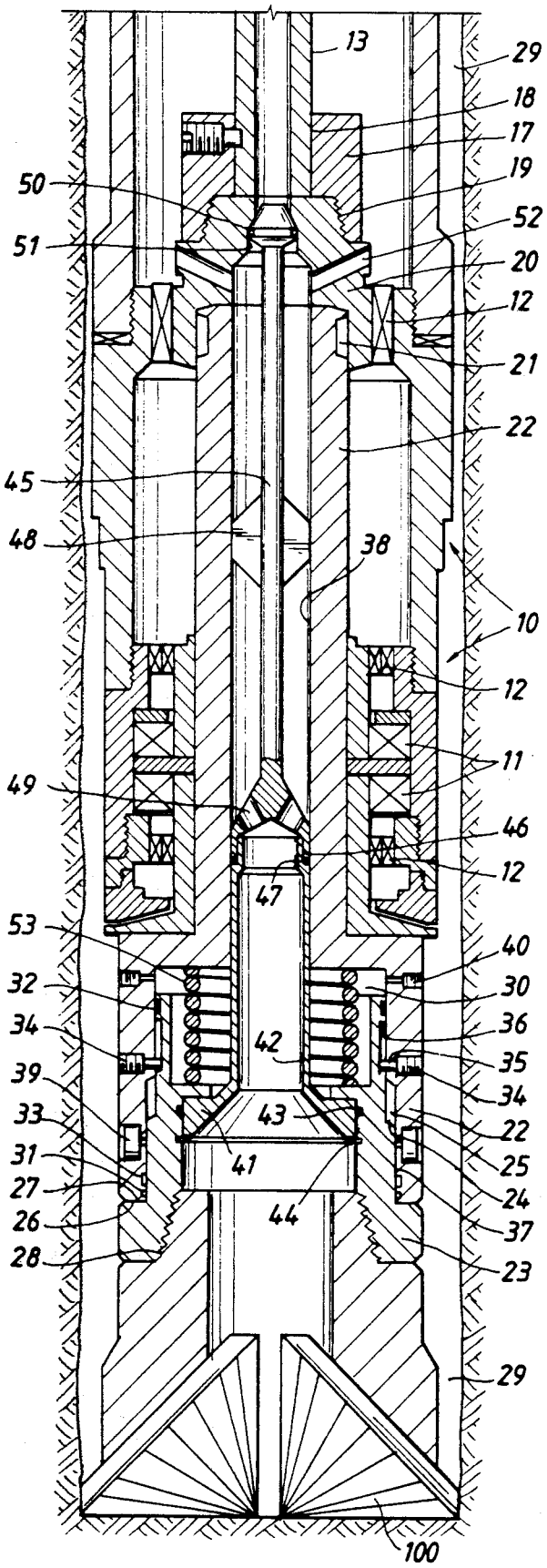
FIG. 2 is a longitudinal sectional view of the preferred embodiment of this invention with the actuator sub in the closed and open position.

Referring now to FIG. 2, actuator sub 23 of the preferred embodiment of the invention referenced in FIG. 1 is shown in the closed position. When the actuating sub is in the closed position, the weight/torque is subsequently transferred to the rock bit 100 via a sealing torque and weight carrying API type thread 28.

Fluids in well bore 29 are slidably sealed from the spline lubricating chamber 30 by seal 31. The actuating sub 23 is stabilized by axially moving bushings 32 and 33 and is retained inside the driveshaft 22 by retaining screws 34 (possibly requiring sealing means 35) which contact undercut shoulder 36 when the actuating sub is in the extended position, FIG. 1.

Depending on tolerance of the splines 25 and 24 and seal surfaces 37 and 38 to well bore fluids 29, one may determine whether the lubrication chamber needs to be completely sealed or grease pack/wiper sealed. The completely sealed version would require a compensating pressure means 39 whereas the grease pack/wiper would only require a weephole 40 to prevent entrapment of downhole pressures which would hamper motion of the actuating sub 23 relative to the driveshaft 22.

A center rod extension 41 with through bore 42 is sealed and fixed to the actuating sub 23 via seal 43 and retainer 4. The center rod extension 41 is attached to the center rod 45 via thread or adequate axial load transmitting connection 46. The center rod extension 41 is slidably sealed to drive shaft bore 38 via seal 47. The center rod 45 is centralized inside the drive shaft by stabilizing webs 48 which allow for fluid passage through driveshaft bore 38. Fluid transfers from driveshaft bore 38 to center rod extension bore via crossover ports 49.

The bypass seal 50, also referred to as valve member, is attached to the center rod 45, and operates in and out of seal bore 51, also referred to as a valve seat. The bypass seal 50 opens and closes the path through the flexible member's bore 15. Power fluid passing around the rotor 7 and stator 4 passes into the driveshaft 22 via crossover ports 52.

A spring 53 keeps the sub assembly of actuating sub 23 rod extension 41 and center rod 45 in the extended position in FIG. 1 which keeps the bypass seal open.

A general review of the apparatus function is as follows:

The motor is tripped into the well with the sub assembly of actuating sub 23, center rod extension 41, and center rod 45 in the extended position and bypass seal 50 open. (FIG. 1) this allows fluid to enter the motor and drilling tubular as the rotor 7/stator 4 power portion is fluid bypassed through flex member bore 15.

When fluid begins to circulate, the fluid is directed inside the drill string 1 into the motor top sub 2 where the fluid splits into two paths. One path 54 between the rotor 7/ stator 4 and one path down the flexible member's bore 15. Due to the pressure resistance necessary to rotate the rotor 7 inside the stator 4, the path of least resistance 15 takes most of the fluid, which results in zero to slight rotation of the rotor 7.

The fluid paths commingle at the bypass seal 50 location via the crossover ports 52 and continue together down the driveshaft bore 38 crossover into the center rod extension bore 42 via crossover ports 49 and into the rock bit 100 where they exhaust into the wellbore 29 and return to the surface carrying rock cuttings. The above fluid path requires that the bearing section 10 be of a completed sealed design allowing no drilling fluid to leak between the rotary motions of the driveshaft 22, bearings 11 and 12 and housings of the bearing section 10. These types of bearing sections 10 are available in the industry. Also available are drilling fluid lubricated bearing sections which, typically equipped with internal flow restriction means, will shunt a very small portion of the commingled drilling fluid for bearing lubrication. This small fluid loss would be negligible and typically occurs downstream of the fluid control means (bypass seal 50) of the device.

When weight from the drilling tubular 1 is applied to the motor, the actuating sub 23 collapses the spring 53 and moves in the opposite direction to the weight applied carrying the rod extension 41 and center rod 45 along, closing the bypass seal 50 as shown in FIG. 2. Drilling fluid, blocked by the bypass seal, cannot pass through flexible member's bore 15 and is forced between the rotor 7 stator 4 causing rotation of the drive train items 7, 13, 17, 20, 22, 23, and 100, along with valving numbers 41, 43, 48, and 50.

Should the rock bit 100 be restricted for the purposes of hole or bit cleaning, the weight will also have to overcome the restriction pressure applied to the sliding seal's 47 area. This area and subsequent additional force will have to be taken into consideration for accurate running of the system. Alternate embodiments found in FIGS. 7-9 (discussed in more detail later), with the substitution of another thrust bearing in place of retaining screws 34, would absorb the above-mentioned pressure force and reduce the concept back to a torsion close/open argument. This may be required if high pressure restriction bits are to be run in low torque environments.

When the motor is picked up off bottom or is drilling off of the rock weight applied by the drilling tubular 1 is reduced. The spring 53 and remaining pressure forces push, the actuating sub 23 outward, opening the bypass seal 50 and allowing the fluid to again pass through the flexible member bore 15 which subsequently slows the rotation of the above-mentioned drive train. The device could function without spring 53 if sufficient pressure force were in place.

The process of applying downward weight to and then releasing downward weight from the motor is repeated as the drilling process continues. Should the hole need to be cleaned (fluid circulated without drilling), circulation will ensue with the bypass seal open, thus zero to slow rotation of the motor drive train occurs. The problems discussed in the "prior art" discussion are now addressed by this device.

Now referring to FIGS. 3*a* and 3*b*, an alternate bypass seal or valve member 150 which in this case acts only as a restrictor inside of valve seat 151 when in the force/weight actuated position is shown. This apparatus is useful in situations where excess fluid is needed for cleaning and fix orifice bypasses are less than ideal. FIG. 3*b* shows the off bottom position with the fluid path wide open. FIG. 3*a* shows on bottom position with fluid restricted but not completely blocked.

FIGS. 4*a*–4*e* show yet another embodiment of the bypass seal of the present invention. A bypass valve member 250 is tuned with a spring and bit (spring and bit not shown) so the amount of weight on the bit governs the amount of power fluid directed to the motor. FIG. 4*a* shows the bypass seal wide open to the bypass. A relatively small amount of weight applied to the bit will not totally collapse the spring, FIGS. 4*b*–4*d*, that is bit torque requirements do not require all the power fluid. In FIG. 4*e*, when the spring has bottomed out, valve member 250 is seated in valve seat 251 of the flow commingling/bypass seal sub 220 and all power fluid is being used to drive the bit. This "tuned" response will make a turbine act more like a moineau motor.

Figure 5B:
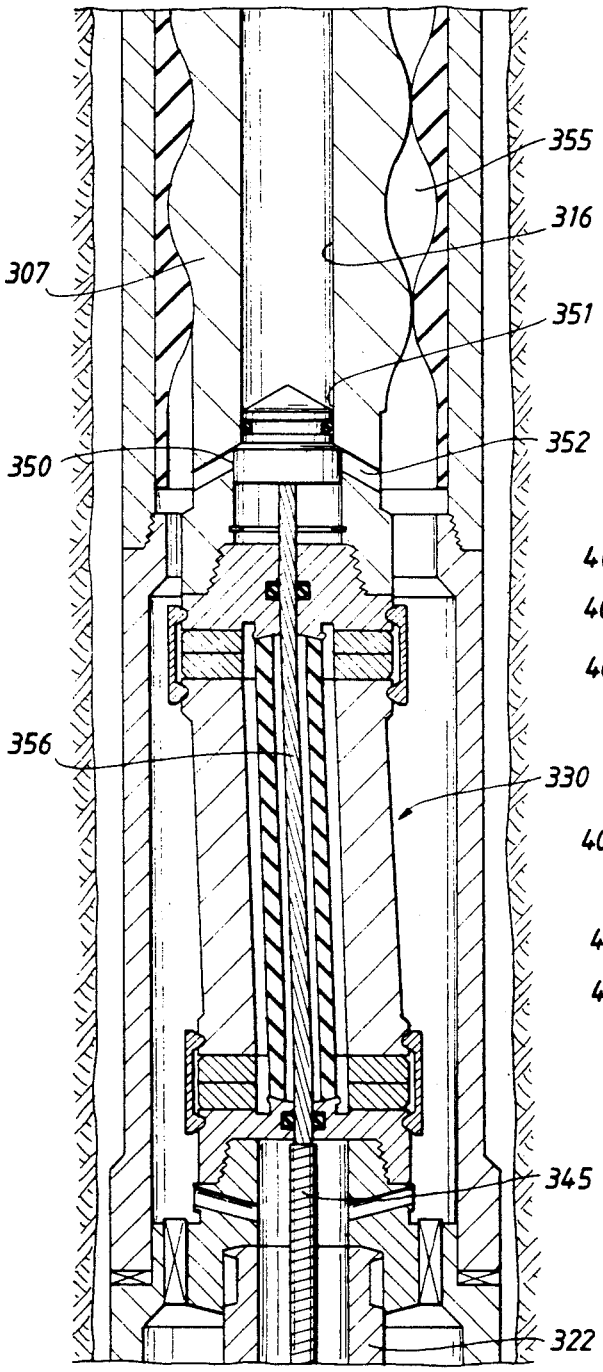

FIG. 5*a* shows conventional cardan type torque transmitting flex coupling 330 which is used in place of flexible member 13 shown in FIGS. 1 and 2. This embodiment is more common in the industry than the preferred embodiment. Internal workings of these couplings 330 would make it difficult to pass a fluid path through them. However, a flexible plunger rod 356 (sealed if joint is lubricated, unsealed otherwise) could be run easily through the inner workings of the couplings 330. The rod's function would be to transfer the force from the center rod 345 to the bypass seal and plunger 350 found in an alternate commingling area in the lower portion of the rotor 307 defined by crossover ports 352, seal seat 351, and rotor through bore 316. FIG. 5*a* shows the off bottom position of the tool with both flow paths 316 and 355 open. FIG. 5*b* shows the on bottom position where rod 345 has moved upward contacting flexible plunger rod 356 and forcing seal and plunger 350 to close off flow seal seat 351. Note that all fluid passes on the outside of the cardan type flex coupling and crosses over into the driveshaft 322 at a similar location as FIGS. 1 and 2.

FIG. 6 shows an alternate power section to the moineau power section of FIGS. 1 and 2. This is a turbine power section defined by stator 404 with stator blades 406 and rotor 407 with rotor blades 460 and through bore fluid passage 416. This embodiment generates no eccentric motion of rotor 407 relative to stator 404 thus a flexible member is not required unless a bend were to be placed in a housing between the power section (rotor/stator) and the bearing section (not shown).

FIG. 7*a* shows an alternate actuation section in which the actuating sub 523 rotates relative to the driveshaft 522 as opposed to axially moving as in prior embodiments. The weight on bit or axial force is not transferred through faces 526 and 527 where here a small clearance is maintained. The force is transferred through the actuating sub 523 to a thrust bearing 561 then into the driveshaft 522. The actuating sub 523 is retained by retaining screws 534 and shoulder 536. FIGS. 7*b* and 7*c* are a cross section view of 'A'—'A' from FIG. 7*a*. FIG. 7*b* shows a open position and FIG. 7*c* shows a closed position. The open position is maintained by what now is a torsion spring 553 (FIG. 7*a*) versus an axial compression spring in previous embodiments. Note, torsion is transmitted through means 562 and 563 which may be bolts, shoulder stops, or similar means. As torque is applied to the bit, the actuating sub 523 rotates until torque transmitting faces 524 and 525 engage as shown in the closed position FIG. 7*c*. The rotation between open and closed is transferred to the center rod extension via locking screws 564 positioned inside antirotation slots 565 in FIG. 7*a*. This rotation then transfers into center rods 545 which actuate rotary gate type or axial screw type valves found in FIGS. 8 and 9, respectively.

FIG. 8*a* shows a rotary gate type valve. FIG. 8*b* is a cross sectional view of the rotary valve in FIG. 8*a* along line B—B, in the open position. The plates of the bypass seal 650 and seal bore 651 align leaving flow passages open. Rotation of the actuating sub, rod extension, and center rod, assembly positions the plates of the seal 650 and seal seat 651 to block flow as shown in the closed position in FIG. 8*c*, viewing in a similar fashion to 8*b*.

FIGS. 9*a* and 9*b* show an alternate rotary actuated seal concept in which the seal or valve member 750 does not rotate, held antirotationally by lugs 766 riding in antirotation slots 767 found in the flow commingling/bypass seal sub 720. Rotation of center rod 745 then causes an axial motion of the seal 750 via rotary actuation means defined by 768 and 769. This will move the valve into the closed position. It is significant enough to note that in off bottom flow conditions where all flow is bypassed through the motor rotor and no slight rotation prevails, embodiments in FIGS. 7*a*–7*c*, FIGS. 8*a*–8*c*, and FIGS. 9*a*–9*b* would not function. Thus these conditions would require additional restriction of the through rotor bypass to assure slight off bottom rotation and subsequent actuation of these embodiments while on bottom.

To anyone skilled in the art, transfer of the axially sealing/metering embodiments found in FIGS. 3*a*–3*b*, FIGS. 4*a*–4*e*, and FIG. 5 could be transferred to the rotary embodiments defined by FIGS. 7–9.

FIGS. 10*a* and 10*b* conversely show the valving means in a normally closed position to all fluid flow. This embodiment would be useful when drilling is underbalanced with incompressible fluid and no returns are coming to the surface. Thus when weight is removed and pumping/motor drilling cease, the column of drilling fluid is held in the string and does not run away into the formation. FIG. 10*a* shows seal 850 seated in sealbore 851 now found in the drive shaft 822 below the fluid commingling area of the fluid commingling sub 820. Fluid from crossover ports 852 is now blocked. Rotor conduit would be closed in this embodiment. Center rod 845 holds the seal 850 as in previous embodiments. FIG. 10*b* shows the on bottom condition where weight pushes the seal 850 open out of the seat 851 and fluid is allowed to flow, and thus power the drilling motor. This embodiment also allows the column of fluid to be the pressuring means to power the motor and provide any necessary bit hydraulics. Thus, only a pump with sufficient volume for the bottom hole assembly will be necessary and the pump's pressure capabilities could be very low thus reducing its horsepower requirements. It would be obvious to one skilled in the art to employ valving means such as those shown in FIGS. 3*a-b* and FIGS. 4*a-4e*, so as to restrict the fluid flow versus completely block it.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A downhole drilling assembly comprising a fluid powered motor having a rotor and a stator and a stator/rotor annulus, the rotor being rotated relative to the stator by drilling fluid pumped through the stator/rotor annulus, tubular torque transmitting means connected to the rotor for rotation therewith and through which drilling fluid can bypass the stator/rotor annulus, a bypass port in the tubular torque transmitting means below the motor through which fluid flowing through the stator/rotor annulus can enter the tubular torque transmitting means, a drill bit having a port through which the drilling fluid can flow out of the drilling assembly and connected to the rotor for rotation therewith, means for restricting the flow of drilling fluid through the tubular bypass means when the weight on the bit is sufficient to provide enough resistance to rotation to keep the speed of the rotor within acceptable limits, and means for opening the flow of drilling fluid through the tubular bypass to thereby reduce the flow of drilling fluid through the stator/rotor annulus when the weight in the bit is insufficient to keep the speed of the rotor within acceptable limits.

2. A downhole drilling assembly in accordance with claim 1 wherein said tubular torque transmitting means comprises an upper flexible member and a rigid hollow drive shaft member separated by said bypass port below the motor, the upper flexible member located within and connected to the top of the rotor.

3. A downhole drilling assembly in accordance with claim 1 wherein said connection of the rotor to the drill bit for rotation comprises an axially slidable mating connector with one part of the connector on the bottom of said tubular torque transmitting means and the mating connector on the drill bit such that when said weight is applied to the tubular torque transmitting member and on the bit sufficient to provide sufficient resistance to rotation, the tubular torque transmitting means will slide down onto the drill bit with the two portions of the mating connector engaged.

4. A downhole drilling assembly in accordance with claim 1 wherein said means for restricting the flow of drilling fluid through the tubular bypass means comprises a bypass valve seat mounted in the tubular torque transmitting member above the port, a bypass valve member for opening and closing the bypass positioned on top of a center rod located within the torque transmitting member below the bypass valve seat for allowing fluid to flow through the member wherein said center rod is mounted to the drill bit such that when the weight on the bit is sufficient to provide enough resistance to rotation, the bit and center rod remain vertically stationary while the bypass valve seat is lowered down onto the bypass valve member forcing fluid to flow through the stator/rotor annulus and the port.

5. A downhole drilling assembly in accordance with claim 1 wherein said tubular torque transmitting bypass means comprises a bypass valve seat mounted in the torque transmitting member above said port and a bypass valve member movably mounted within said torque transmitting member below the bypass valve seat, such that when the seal is in the closed position, the valve member is seated, fluid enters and flows down into the tubular torque transmitting member through the port from the stator/rotor annulus.

6. A downhole drilling assembly in accordance with claim 5 wherein said fluid is completely blocked from traveling within the tubular torque transmitting member above the bypass valve seat when the bypass valve member is seated on the bypass valve seat.

7. A downhole drilling assembly in accordance with claim 5 wherein said fluid is restricted from traveling within the torque transmitting member above the bypass valve seat when the bypass valve member is seated within the bypass valve seat.

8. A downhole drilling assembly in accordance with claim 5 wherein said bypass valve seat comprises a conical stairstep shaped valve seat such that as weight is applied the bypass valve member enters the bottom of the cone allowing fluid to pass between the bypass valve member and the bypass valve seat and, as more weight is applied, the amount of fluid passing the bypass valve member is reduced.

9. A downhole drilling assembly in accordance with claim 1 wherein said tubular torque transmitting bypass means comprise a rotary gate type valve such that when valve is closed fluid enters and flows down into the tubular torque transmitting member to the bypass port from the stator/rotor annulus.

10. A downhole drilling assembly in accordance with claim 1 wherein said tubular torque transmitting bypass means comprise an axial screw type valve such that when valve is closed fluid enters and flows down into the tubular torque transmitting member to the bypass port from the stator/rotor annulus.

11. A downhole drilling assembly in accordance with claim 1 wherein said tubular torque transmitting member includes a cardan type torque transmitting flex coupling located below the bypass positioned in such a way as to divide the tubular torque transmitting member into a top portion including the bypass and a drive shaft member below the cardan type transmitting flex coupling such that fluid flows out of the top portion around the cardan type torque transmitting flex coupling and back into the drive shaft.

12. A downhole drilling assembly comprising a fluid powered motor having a rotor and a stator, the rotor being rotated relative to the stator by drilling fluid pumped through the stator/rotor annulus, a drill bit connected to the rotor for rotation therewith, said drill bit having a port through which the drilling fluid can flow out of the drilling assembly, a tubular torque transmitting means including a fluid restrictor means connected to the rotor for rotation therewith, a port in the tubular torque transmitting means below the motor through which fluid flowing through the stator/rotor annulus can enter the tubular torque transmitting means, means for allowing the flow of drilling fluid through tubular torque transmitting means when the weight on the bit is sufficient to open the restriction means to allow flow to pass through the rotor and stator to cause rotation of the drill bit, and means for closing the flow of drilling fluid through the bypass means to thereby prevent the flow of drilling fluid through the stator/rotor annulus when the weight on the bit is insufficient to keep the restrictor open to the flow of fluid.

13. A downhole drilling assembly in accordance with claim 12 wherein said means for allowing the flow of drilling fluid through the tubular torque transmitting means a valve seat mounted in the tubular torque transmitting member below the port, a valve member for opening and closing the valve seat, said valve member positioned on top of a center rod located within the torque transmitting member below the port such that when the valve member is not seated, fluid flows through the tubular torque transmitting means, wherein said center rod is mounted to the drill bit such that when the weight on the bit is sufficient to provide enough resistance to the pressure of the fluid column, the bit and center rod remain vertically stationary while the valve seat is lowered down away from valve member allowing fluid to flow through the stator/rotor annulus and the port.

* * * * *

UNITED STATES PATENT AND TRADEMARK OFFICE

CERTIFICATE OF CORRECTION

PATENT NO. : 5,174,392

DATED : Dec. 29, 1992

INVENTOR(S) : Paul A. Reinhardt

It is certified that error appears in the above-identified patent and that said Letters Patent is hereby corrected as shown below:

Column 5, line 51, after "retainer", change "4" to —44—;

Column 6, line 44, after "valving", change "numbers 41, 43" to —members 41, 45—;

Column 6, line 60, after "reduced", change ". The" to —, the—;

Column 8, line 2, after "section", change "view of 'A' - 'A'" to —views along line 7b-7b—;

Column 8, line 19, after "line", change "B-B" to —8b-8b—;

Column 12, after line 7, insert the following claims:

--14. A downhole drilling assembly in accordance with claim 1 wherein said tubular torque transmitting means comprises an upper flexible member and a rigid hollow drive shaft member separated by said bypass port below the motor, the upper flexible member located below and connected to the bottom of the rotor.

UNITED STATES PATENT AND TRADEMARK OFFICE

CERTIFICATE OF CORRECTION

PATENT NO. : 5,174,392

DATED : Dec. 29, 1992

INVENTOR(S) : Paul A. Reinhardt

It is certified that error appears in the above-identified patent and that said Letters Patent is hereby corrected as shown below:

15. A downhole drilling assembly in accordance with claim 1 wherein said tubular torque transmitting means includes a two-piece torque transmitting, valve actuating flexible member located below the bypass positioned in such way as to divide the tubular torque transmitting means into a top portion including the bypass and a drive shaft member below the two-piece torque transmitting, valve actuating flexible member such that fluid flows out of the top portion around the two-piece torque transmitting, valve actuating flexible member and back into the drive shaft.

16. A downhole drilling motor in accordance with claim 1 wherein said rotor and stator are arranged to define a moineau power section.

17. A downhole drilling motor in accordance with claim 1 wherein said rotor and stator are arranged to define a turbine power section.

UNITED STATES PATENT AND TRADEMARK OFFICE

CERTIFICATE OF CORRECTION

PATENT NO. : 5,174,392

DATED : Dec. 29, 1992

INVENTOR(S) : Paul A. Reinhardt

It is certified that error appears in the above-identified patent and that said Letters Patent is hereby corrected as shown below:

18. A downhole drilling motor in accordance with claim 12 wherein said rotor and stator are arranged to define a Moineau type power section.

19. A downhole drilling motor in accordance with claim 12 wherein said rotor and stator are arranged to define a turbine power section.--

Signed and Sealed this

First Day of June, 1993

Attest:

Michael K. Kirk

MICHAEL K. KIRK

Attesting Officer

Acting Commissioner of Patents and Trademarks